US007186133B1

(12) United States Patent
Szczesny

(10) Patent No.: US 7,186,133 B1
(45) Date of Patent: Mar. 6, 2007

(54) CONNECTOR WITH ROTATABLE CABLE EXIT

(75) Inventor: David S. Szczesny, Hershey, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/216,630

(22) Filed: Aug. 31, 2005

(51) Int. Cl.
*H01R 13/56* (2006.01)

(52) U.S. Cl. ..... 439/446

(58) Field of Classification Search ..... 439/446, 439/6, 13, 464, 471, 840, 371
See application file for complete search history.

(56) References Cited

U.S. PATENT DOCUMENTS 4,810,213 A * 3/1989 Chabot ..... 439/825
5,911,595 A * 6/1999 Orr et al. ..... 439/471
6,644,999 B1 * 11/2003 Tan et al. ..... 439/446
7,074,087 B2 * 7/2006 Szczesny et al. ..... 439/610
2004/0216912 A1 * 11/2004 Osborn, Jr. ..... 174/73.1

OTHER PUBLICATIONS

U.S. Appl. No. 11/153,028, Resser et al.

* cited by examiner

*Primary Examiner*—Tho D. Ta
*Assistant Examiner*—Vanessa Girardi

(57) ABSTRACT

A cable connector includes a housing having a mating end and a cable exit end. A ferrule is rotatably retained in the housing proximate the cable exit end. The ferrule is rotatable within a predetermined range with respect to the housing. The housing includes an arcuate slot having end edges and the ferrule includes a protrusion received in the slot. The protrusion is movable between the end edges to define the predetermined range of rotation of the ferrule. The ferrule includes an inlet end defining an inlet centerline and a body bent at an acute angle with respect to the inlet centerline.

17 Claims, 5 Drawing Sheets

CONNECTOR WITH ROTATABLE CABLE EXIT

BACKGROUND OF THE INVENTION

This invention relates generally to electrical connectors, and more specifically to a cable connector assembly having a rotatable cable exit that is suitable for use with a shielded cable.

Electrical systems exist that include shielded cable assemblies for transmitting electrical signals. Conductive metallized braids are coupled to the cable and surround the signal conductors in the cable for shielding purposes, and the metallized braids are connected to shielding features of connectors and components which ultimately provide a conductive path to ground. In systems of this type, connectors for shielded cables often include conductive metal shells. Some conventional metal shells include integral ferrule surfaces formed therewith which aid in connecting the cable braid to the shells. The cable braid is extended over the ferrule surfaces of the shells, and outer ferrule elements are attached over and crimped to the cable braid, thereby trapping the cable braid between the ferrule surfaces of the shell and the outer ferrule elements.

In some applications, several connectors may be mounted side-by-side on a circuit card or a panel. Many times, when the cables exit the connectors, all of the cables must be turned up or down, left or right to be run in the same direction, such as into a raceway. Typically, technicians forcibly bend the cables in order to route the cables in a desired direction or fit the cables into a raceway. Care must be taken, however, to avoid damage to the cable that may result from excessive pulling or twisting on the cable. Further, as cables and cable bundles become larger, safe manipulation of the cables, such as in fitting the cables into a raceway, becomes more difficult.

BRIEF DESCRIPTION OF THE INVENTION

In one aspect, a cable connector is provided. The cable connector includes a housing having a mating end and a cable exit end. A ferrule is rotatably retained in the housing proximate the cable exit end. The ferrule is rotatable within a predetermined range with respect to the housing.

Optionally, the housing includes an arcuate slot having end edges and the ferrule includes a protrusion received in the slot. The protrusion is movable between the end edges to define the predetermined range of rotation of the ferrule. The ferrule includes an inlet end defining an inlet centerline and a body bent at an acute angle with respect to the inlet centerline. The housing includes an interior channel formed proximate the cable exit end. The ferrule has flanges formed thereon that are received in the interior channel to retain the ferrule within the housing. The ferrule includes a groove that receives a conductive gasket between the ferrule and the housing. The conductive gasket includes a coil spring. The ferrule includes a pair of flanges formed on an exterior thereof. The flanges define the groove that receives the conductive gasket.

In another aspect, a cable connector is provided that includes a housing having a mating end and a cable exit end. A ferrule has an inlet end rotatably retained in the housing proximate the cable exit end. The inlet end defines an inlet centerline about which the ferrule rotates within a predetermined range with respect to the housing. The ferrule includes a body bent at an acute angle with respect to the inlet centerline of the ferrule.

DETAILED DESCRIPTION OF THE INVENTION

Figure 1:
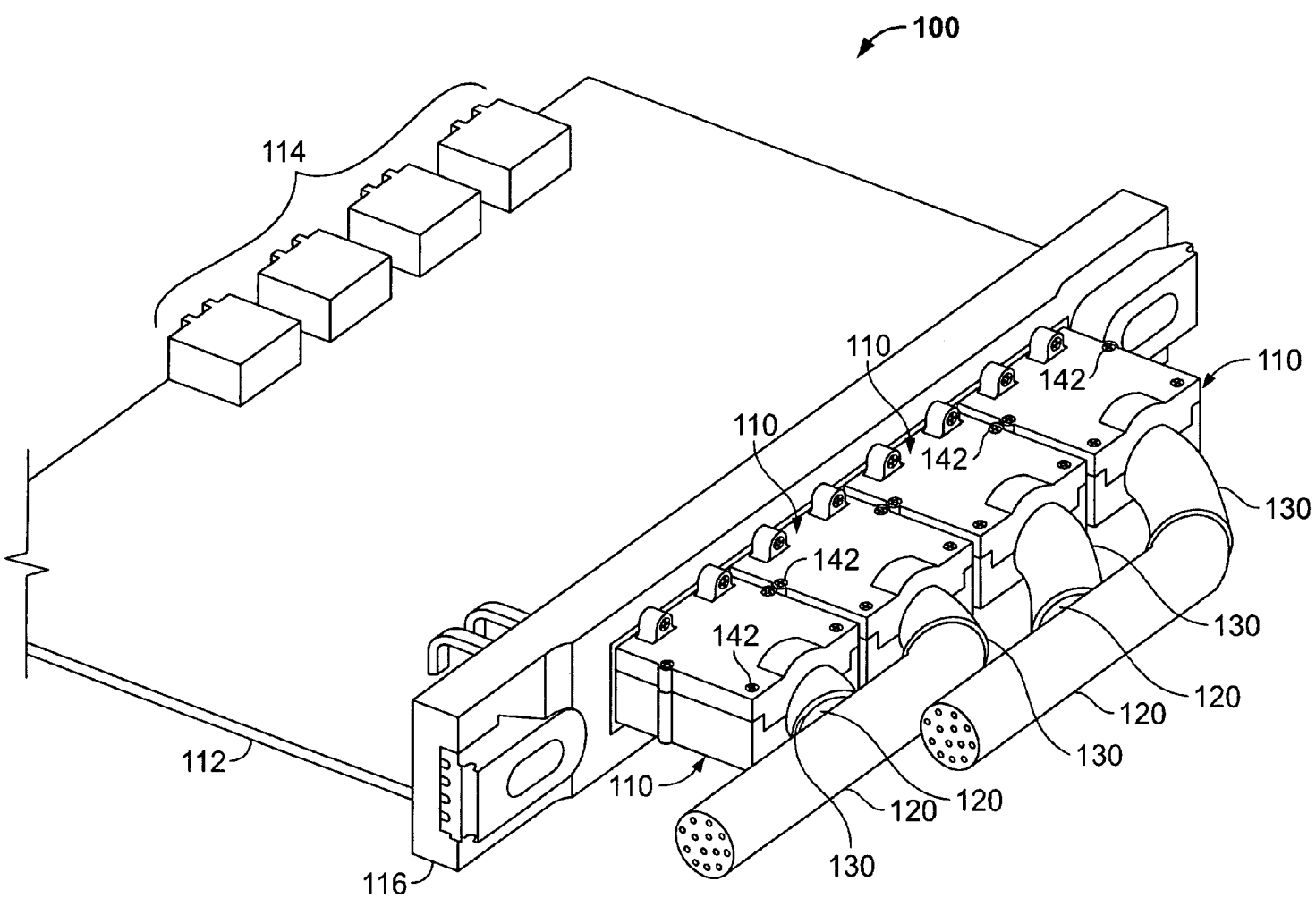
FIG. 1 is a perspective view of an electrical interface including connectors formed in accordance with an exemplary embodiment of the present invention.

FIG. 1 is a perspective view of an electrical interface 100 having a plurality of connectors 110 connected thereto. Each of the connectors 110 is formed in accordance with an exemplary embodiment of the present invention. The interface 100 includes a circuit card 112 that is suitable for use in, for instance, a main frame computer or in a rack mount application. The circuit card 112 may have a number of connectors 114 mounted thereon that connect the circuit card 112 to computer or network resources. The interface 100 includes a front panel or faceplate 116 to which the connectors 110 are attached. Each of the connectors 110 connects a multi-wire cable 120 to the circuit card 112. In particular, the cables 120 may be shielded cables. Each of the connectors 110 includes a rotatable ferrule 130 that extends at an angle from the connector 110. The angled and rotatable ferrule 130 facilitates routing of the cables 120 in a given direction. As illustrated in FIG. 1, the cables 120 are routed in the same direction, as is common when the cables are contained and routed within a raceway, but the ferrules 130 may be rotated individually to route the cables 120 in different directions.

Figure 2:
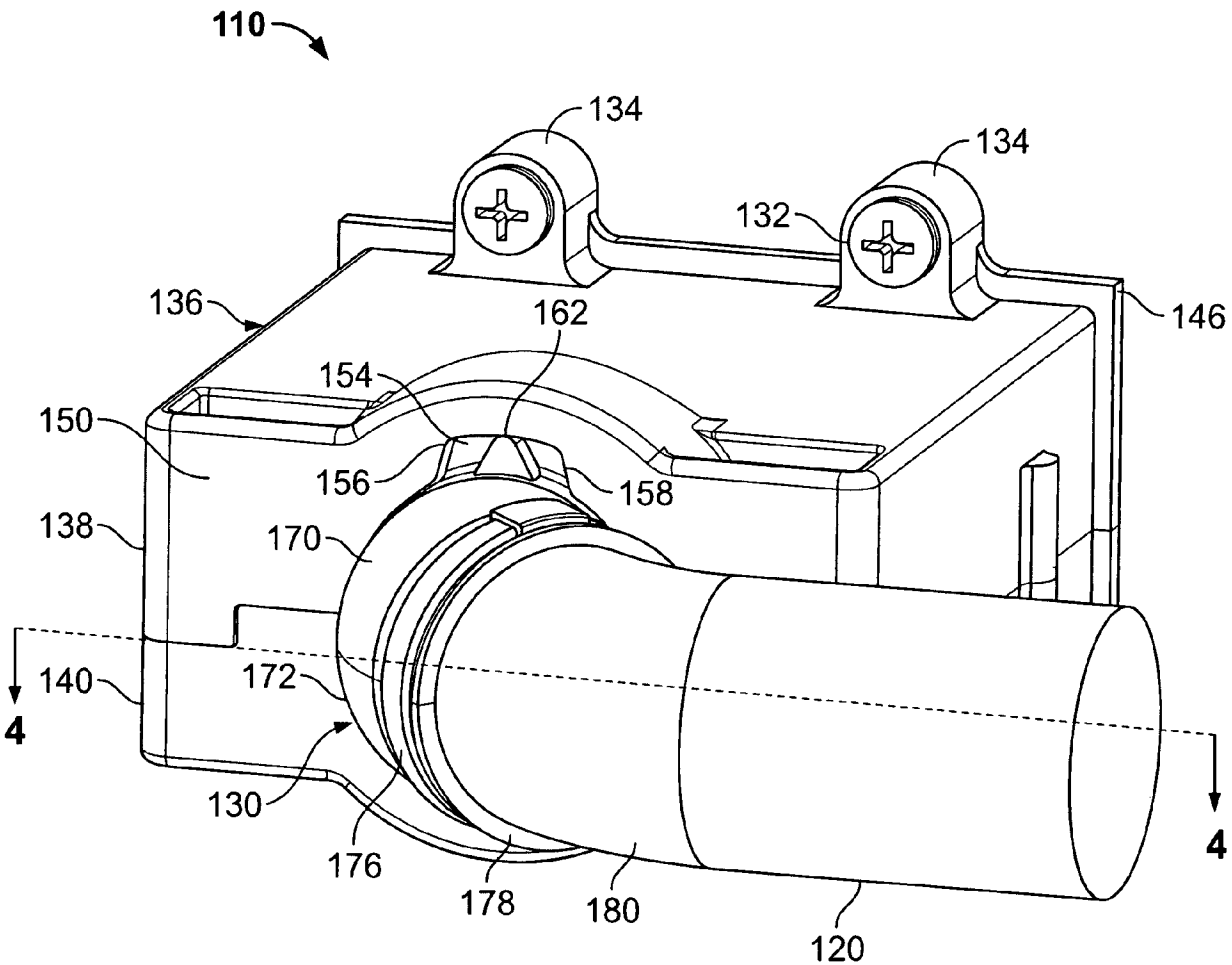
FIG. 2 is a perspective view of a connector shown in FIG. 1.

FIG. 2 is a perspective view of the connector 110. The connector 110 may be mounted on the front panel 116 (FIG. 1) such as with, but not limited to, threaded fasteners 132 that are received in mounting towers 134. The connector 110 includes a housing 136 having an upper shell 138 and a lower shell 140 that are held together with fasteners 142 (FIG. 1) that extend from the lower shell 140 to the upper shell 138 as shown in FIG. 1, wherein the connectors 110 are oriented with the lower shell 140 facing upward. The housing 136 has a mating end 146 and a cable exit end 150. A contact module 184 (see FIG. 4) is held in the housing 136 proximate the mating end 146.

The ferrule 130 is rotatably retained in the cable exit end 150 of the housing 136. A slot 154 is formed in the cable exit end 150. The slot 154 has an arcuate shape and defines end edges 156 and 158. A protrusion 162 is formed on the ferrule 130. The protrusion 162 extends radially from the ferrule 130 and is positioned within the slot 154. The protrusion 162 is movable within the slot 154 between the end edges 156 and 158 and thereby defines a range of rotation of the ferrule 130 with respect to the housing 136. The ferrule 130 includes a first ferrule element 170 and a second ferrule element 172 that are joined together. A retainer 176 is provided on the ferrule 130 at a ferrule exit 178 to grip the cable 120 at the ferrule exit 178. More specifically, the retainer 176 grips a shielding layer 180 of the cable 120. In one embodiment, the retainer 176 includes a band around the ferrule exit 178 to clamp the ferule 130 to the shielding layer 180 of the cable 120. Alternatively, the retainer 176 may include a sleeve (not shown) that receives the ferrule exit end 178 and the cable 120. The sleeve is crimped to the ferrule exit 178 and the shielding layer 180 of the cable 120. It is to be understood that other known clamping mechanisms are not intended to be excluded.

In an exemplary embodiment, each of the upper and lower shells 138 and 140 are fabricated from a conductive material, such as die cast metal, and the shells 138 and 140 form a protective enclosure about the ferrule 130 and the contact module 184 (see FIG. 4) when the shells 138 and 140 are coupled to one another. The upper and lower shells 138 and 140 are generally rectangular in shape and are sized and dimensioned to securely receive and retain the contact module 184 and rotatably retain the ferrule 130.

Figure 3:
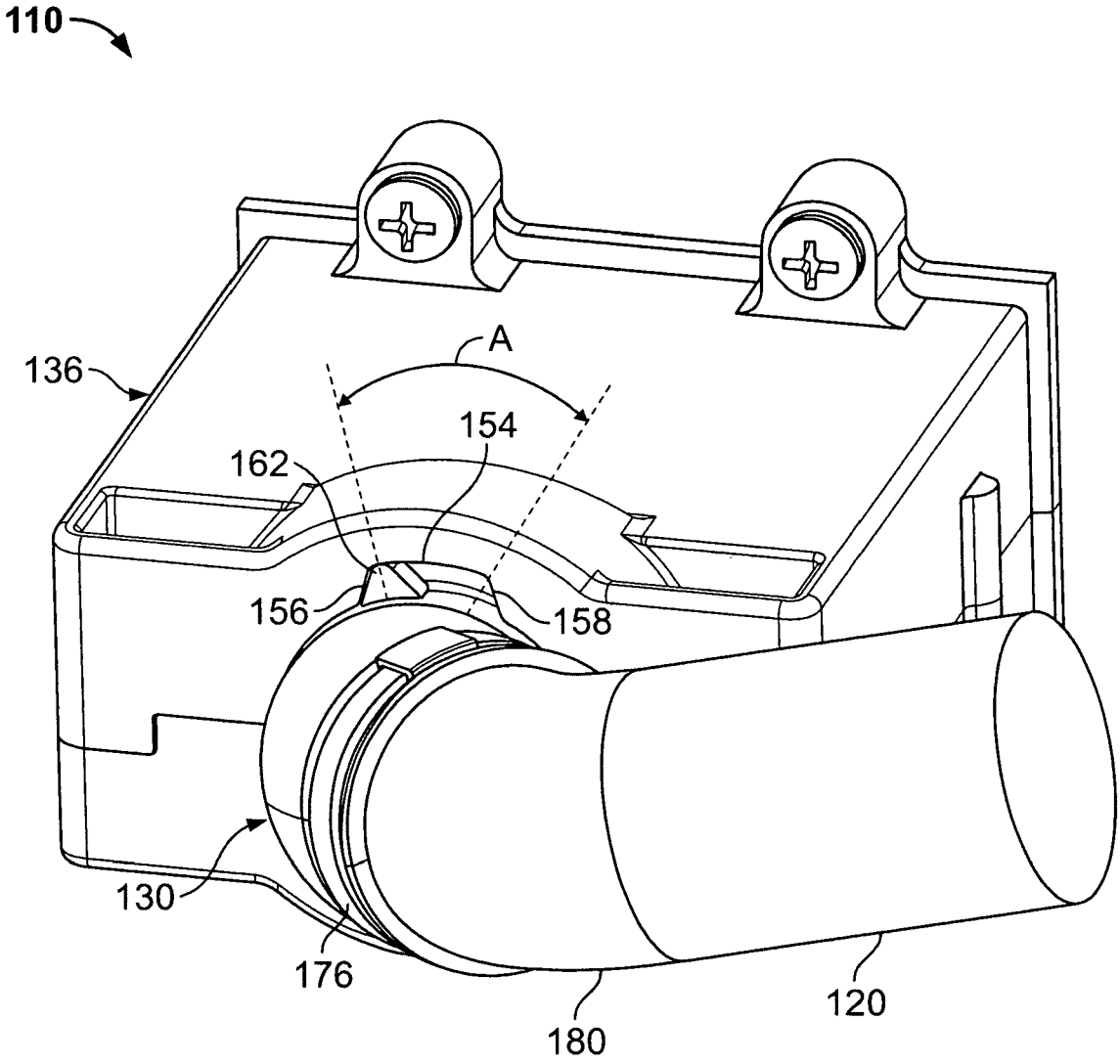
FIG. 3 is a perspective view of the connector shown in FIG. 2 with the ferrule rotated to an extreme position.

FIG. 3 is a perspective view of the connector 110 with the ferrule 130 rotated to a counterclockwise most position. As illustrated in FIG. 3, the protrusion 162 is in engagement with the end edge 156 of the slot 154. The ferrule 130 is rotatable through a predetermined range of rotation corresponding to the angle A with respect to the housing 136. The range of rotation is limited so as not to damage the cable 120. In an exemplary embodiment, the range of rotation is less than ninety degrees. In some applications, however, the range of rotation may exceed ninety degrees. When assembled, the retainer 176 clamps the ferrule 130 to the shielding layer 180 of the cable 120 such that the shielding layer 180 and the cable 120 are fixedly attached to the ferrule 130. Thus, the cable 120 rotates with the ferrule 130 as the ferrule 130 is rotated between the limits determined by the protrusion and the end edges 156 and 158 of the slot 154. In this manner, the cable 120 and the contact module 184 (FIG. 4) are not subjected to excessive stress.

Figure 4:
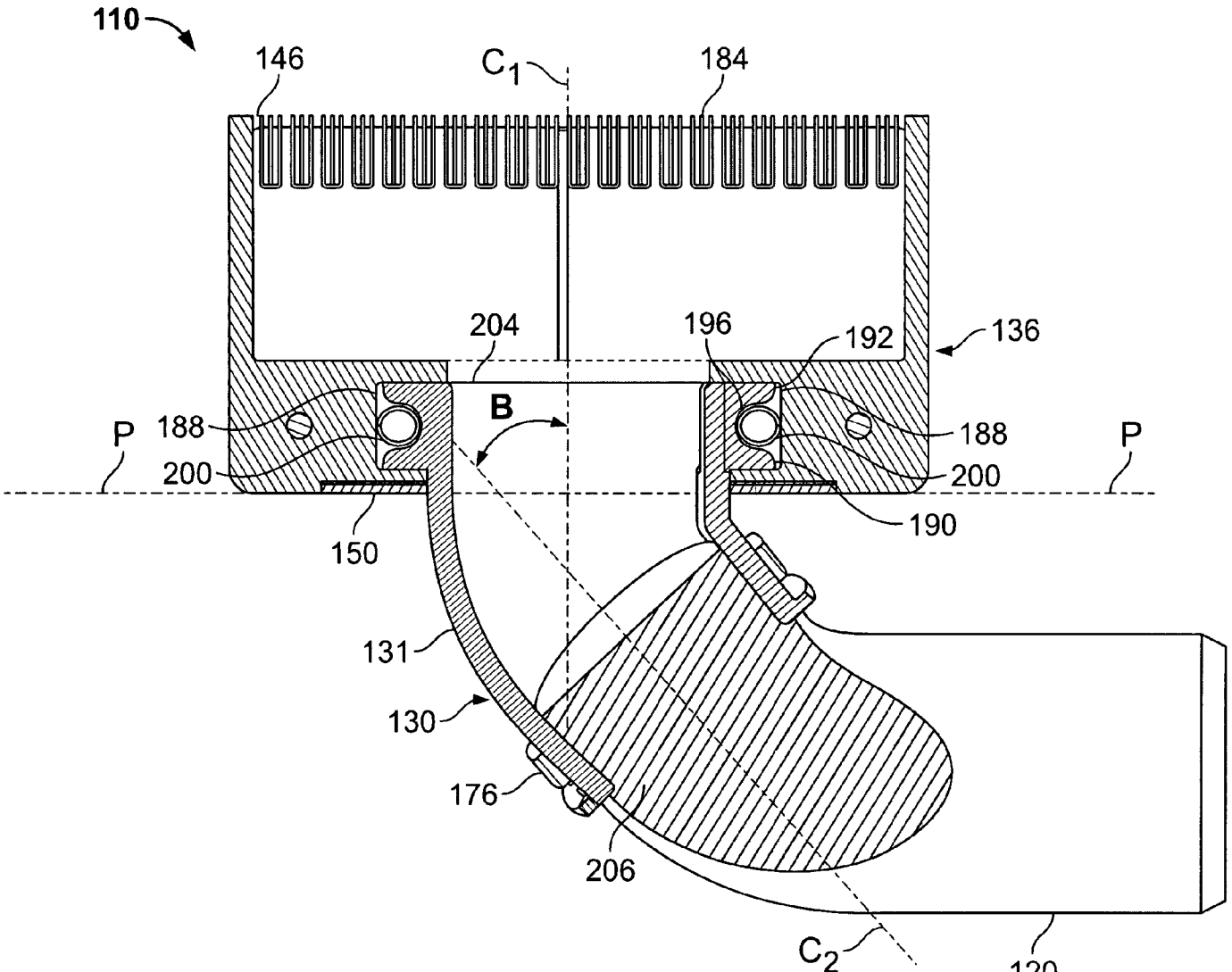
FIG. 4 is a cross sectional view of the connector shown in FIG. 2 taken along the line 4—4.

FIG. 4 is a cross sectional view of the connector 110. A contact module 184 is received in the housing 136 proximate the mating end 146. The contact module 184 is fixedly held in the housing 136 and is configured to mate with a connector (not shown) on the faceplate 116 (FIG. 1). The housing 136 includes a circumferential channel 188 formed in the interior thereof proximate the cable exit end 150. The ferrule 130 includes a pair of circumferential flanges 190 and 192 formed on the exterior of the ferrule 130. The flanges 190 and 192 define a groove 196 therebetween that receives a conductive gasket 200 which is held between the ferrule 130 and the housing 136. In one embodiment, the conductive gasket 200 is a coil spring. The conductive gasket 200 establishes an electrical connection between the housing and ferrule 130, thereby providing a conductive path for grounding the shielding layer 180 (FIG. 3). The conductive gasket 200 also provides shielding against electromechanical interference (EMI).

The ferrule 130 has an inlet end 204 and an outlet end 206. The inlet end 204 is rotatably received in the housing 136 proximate the cable exit end 150. More specifically, the flanges 190 and 192 are received in the housing channel 188 so that the ferrule 130 is rotatably retained in the housing 136. The inlet end 204 defines an inlet centerline $C_1$ about which the ferrule 130 rotates. The cable exit end 150 of the housing 136 defines a plane P. The inlet centerline $C_1$ is perpendicular to the plane P. The ferrule 130 includes a body 131 that extends from the cable exit end 150 of the housing 136. The outlet end 206 defines an outlet centerline $C_2$ that intersects the inlet centerline $C_1$ at an angle B. That is, the outlet end 206 of the ferrule 130 extends at the angle B with respect to the inlet centerline $C_1$. Further, the body 131 bends at an angle denoted by B with respect to the inlet centerline $C_1$ of the inlet end 204 of the ferrule 130. Consequently, the body 131 extends in a non-parallel manner from the inlet centerline $C_1$. In an exemplary embodiment the angle B is an acute angle. The bend on the body 131 facilitates routing the cable 120 at an angle at the cable exit end 150 of the housing 136.

Figure 5:
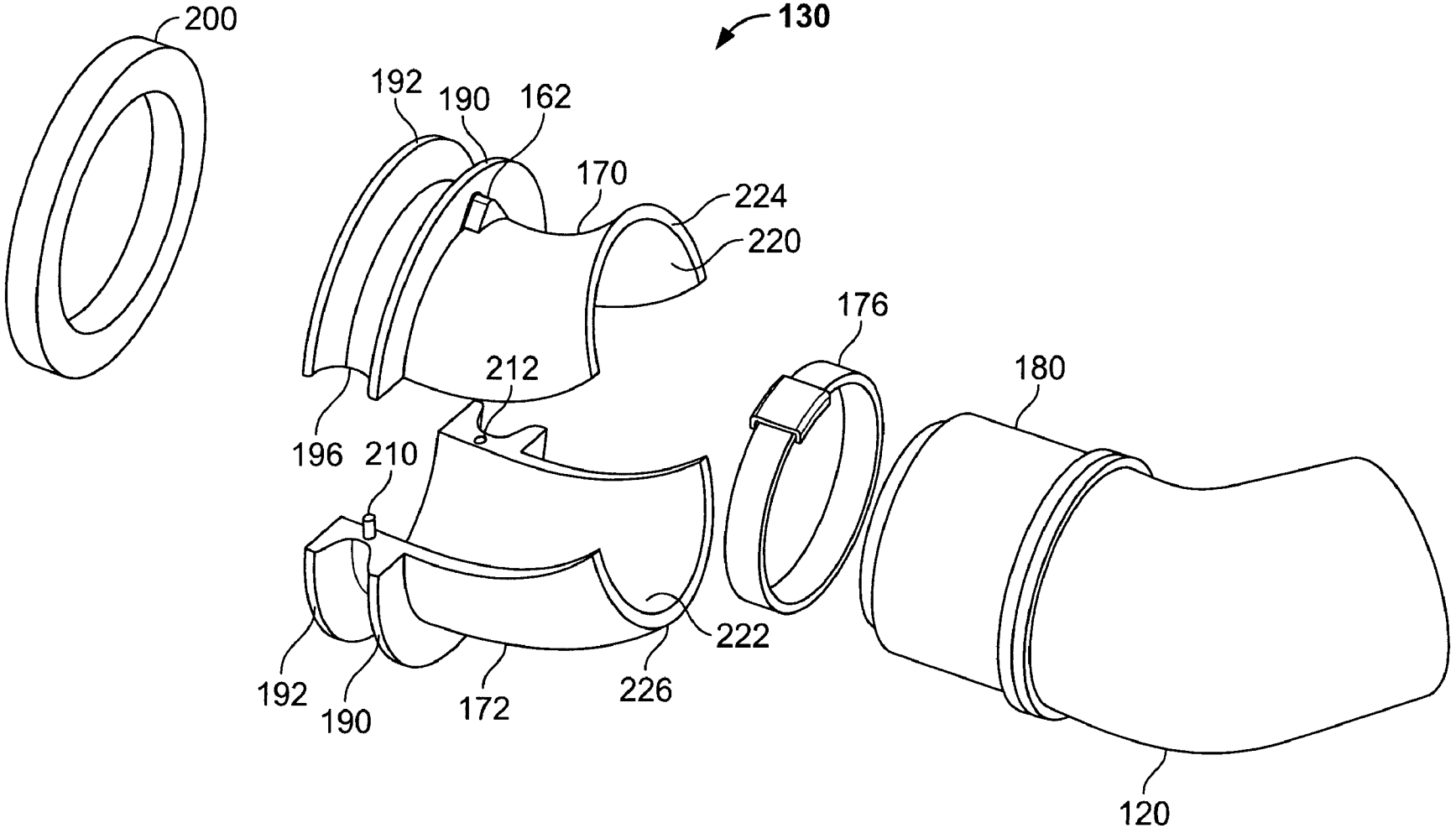
FIG. 5 is an exploded view of the ferrule shown in FIG. 2.

FIG. 5 is an exploded view of the ferrule 130 shown in FIG. 2. The ferrule 130 includes the first and second ferrule elements 170 and 172 respectively, the retainer 176, and the conductive gasket 200. The protrusion 162 is formed on the first ferrule element 170. The ferrule elements 170 and 172 join together to form a substantially cylindrical sleeve that receives the cable 120. Each ferrule element 170 and 172 has a pin 210 and an aperture 212 to facilitate joining the ferrule elements 170 and 172 with one another. The ferrule elements 170 and 172 include respective semi cylindrical and inner surfaces 220 and 222 and retaining lips 224 and 226 formed at the cable outlet end 206 (FIG. 4). Retaining lips 224 and 226 extend radially outward from inner surfaces 220 and 222, respectively.

When assembled to a cable 120, the cable shielding layer 180 is rolled back over the cable 120 and the cable 120 is inserted between the ferrule element inner surfaces 220 and 222. The shielding layer is then pulled over the ferrule elements 170 and 172. The retainer 176 is then positioned over the shielding layer 180 and the ferrule elements 170 and 172 and tightened. The conductive gasket 200 is inserted in the groove 196 formed between the flanges 190 and 192. The conductive gasket 200 extends slightly beyond the groove 196 so that when the ferrule 130 is installed in the housing 136 (FIG. 4), the conductive gasket 200 is slightly compressed and engages both the housing 136 and the ferrule 130 and provides a conductive path therebetween. The conductive gasket 200 also provides some suppression of electromechanical interference. Finally, the ferrule 130 is installed in the housing 136 (FIG. 2) so that the protrusion 162 is positioned within the slot 154 in the housing 136.

The embodiments thus described provide a cable connector 110 including a ferrule 130 that provides a rotatable exit from the connector 110 that facilitates manipulation of the cable 120 to route the cable 120 in a particular direction, such as along a raceway. The ferrule 130 is formed with a bend that facilitates turning or bending the cable 120 without subjecting the cable 120 to excessive stress to prevent damage to the cable 120. The connector 110 is particularly useful in applications having multiple connectors 110 mounted in close proximity to one another.

While the invention has been described in terms of various specific embodiments, those skilled in the art will recognize that the invention can be practiced with modification within the spirit and scope of the claims.

What is claimed is:

1. A cable connector comprising:

a housing having a mating end and a cable exit end that define and extend along parallel mating and cable exit planes, respectively; and a ferrule rotatably retained in said housing proximate said cable exit end, said ferrule including an inlet end that defines an inlet centerline that is oriented perpendicular to said mating and cable exit planes, wherein said ferrule is rotatable about said inlet centerline within a predetermined range with respect to said housing, wherein said housing includes an arcuate slot having end edges and said ferrule includes a protrusion received in said slot, said protrusion being movable between said end edges to define said predetermined range of rotation of said ferrule.

2. The cable connector of claim 1, wherein said ferrule includes a body that extends from said inlet end along said inlet centerline, said body having a bent portion that is bent at an acute angle with respect to said centerline, said bent portion being located intermediate between said inlet and an outlet end of said ferrule.

3. The cable connector of claim 1, wherein said housing includes an interior channel formed proximate said cable exit end, said interior channel being aligned parallel to said cable exit plane and said mating plane and said ferrule having flanges formed thereon, said flanges being rotatable in said interior channel along a plane parallel to said mating plane of said mating end of said housing.

4. The cable connector of claim 1, wherein said ferrule includes a pair of flanges formed on an exterior thereof, said flanges defining a groove that receives a conductive gasket between said ferrule and said housing, said ferrule and housing being fabricated from a conductive material.

5. The cable connector of claim 1, wherein said ferrule includes a groove that receives a conductive gasket between said ferrule and said housing, said conductive gasket comprising a coil spring.

6. The cable connector of claim 1, wherein said housing includes a contact module held in said housing proximate said mating end.

7. The cable connector of claim 1, wherein said connector further includes a retainer around one end of said ferrule, said retainer configured to clamp said ferrule to a shielding layer of a cable.

8. The cable connector of claim 1, wherein said housing and said ferrule are fabricated from a conductive material.

9. The cable connector of claim 1, wherein said ferrule is configured to engage a shielding layer of a cable.

10. A cable connector comprising:

a housing having a mating end and a cable exit end; and a ferrule having a body with an inlet end and an outlet end, said inlet end being rotatably retained in said housing proximate said cable exit end, said inlet end defining an inlet centerline about which said ferrule rotates within a predetermined range with respect to said housing, said body of said ferrule including a bent portion located at an intermediate point along said body between said inlet and outlet ends, said bent portion being bent at an acute angle with respect to said inlet centerline of said ferrule, wherein said ferrule includes a pair of flanges formed on an exterior thereof, said flanges defining a groove that receives a conductive gasket between said ferrule and said housing, said ferrule and housing being fabricated from a conductive material.

11. The cable connector of claim 10, wherein said housing includes an arcuate slot having end edges and said ferrule includes a protrusion received in said slot, said protrusion being movable between said end edges to define said predetermined range of rotation of said ferrule.

12. The cable connector of claim 10, wherein said housing includes an interior channel formed proximate said cable exit end to receive said pair of flanges.

13. The cable connector of claim 10, wherein said ferrule includes a groove that receives said conductive gasket between said ferrule and said housing, said conductive gasket comprising a coil spring.

14. The cable connector of claim 10, wherein said housing includes a contact module held in said housing proximate said mating end.

15. The cable connector of claim 10, wherein said connector further includes a retainer around one end of said ferrule, said retainer configured to clamp said ferrule to a shielding layer of a cable.

16. The cable connector of claim 10, wherein said housing and said ferrule are fabricated from a conductive material.

17. The cable connector of claim 10, wherein said inlet centerline extends perpendicular to said mating end of said housing.

* * * * *